US010626480B2

(12) United States Patent
Iseki et al.

(10) Patent No.: US 10,626,480 B2
(45) Date of Patent: Apr. 21, 2020

(54) METHOD FOR SMELTING OXIDE ORE

(71) Applicant: SUMITOMO METAL MINING CO., LTD., Tokyo (JP)

(72) Inventors: Takashi Iseki, Niihama (JP); Yukihiro Goda, Niihama (JP); Jun-ichi Kobayashi, Niihama (JP); Shuji Okada, Niihama (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 0 days.

(21) Appl. No.: 16/609,599

(22) PCT Filed: May 11, 2018

(86) PCT No.: PCT/JP2018/018395
§ 371 (c)(1),
(2) Date: Oct. 30, 2019

(87) PCT Pub. No.: WO2018/216513
PCT Pub. Date: Nov. 29, 2018

(65) Prior Publication Data

US 2020/0056262 A1 Feb. 20, 2020

(30) Foreign Application Priority Data

May 24, 2017 (JP) ..... 2017-103028

(51) Int. Cl.
*C22B 5/10* (2006.01)
*C22B 1/248* (2006.01)
*C22C 33/06* (2006.01)

(52) U.S. Cl.
CPC ..... *C22B 5/10* (2013.01); *C22B 1/248* (2013.01); *C22C 33/06* (2013.01)

(58) Field of Classification Search
CPC ..... C22B 5/10; C22B 1/248; C22C 33/06
See application file for complete search history.

(56) References Cited

U.S. PATENT DOCUMENTS

2013/0074654 A1 3/2013 Ito
2017/0306444 A1 10/2017 Takahashi et al.
2018/0209012 A1* 7/2018 Hosono ..... C21B 13/006

FOREIGN PATENT DOCUMENTS

AU 2018254139 A1 10/2019
JP S48-045418 A 6/1973
(Continued)

OTHER PUBLICATIONS

Office Action dated Dec. 3, 2019, issued in the AU Patent Application No. 2018271516.
(Continued)

*Primary Examiner* — Anthony J Zimmer
*Assistant Examiner* — Ricardo D Morales
(74) *Attorney, Agent, or Firm* — Locke Lord LLP

(57) ABSTRACT

In a method for producing a metal or alloy by forming pellets from an oxide ore, a method for smelting an oxide ore, wherein a high-quality metal can be produced. Provided is a method for smelting an oxide ore to produce a metal or alloy by heating for reducing a mixture containing an oxide ore and a carbonaceous reducing agent, wherein the carbonaceous reducing agent is composed of particles (reducing agent particles), the number of reducing agent particles which are contained in the carbonaceous reducing agent and have a maximum particle length of 25 μm or less is 2% or more and 25% or less of the total number of reducing agent particles contained in the carbonaceous reducing agent, and the average maximum particle length of reducing agent particles having a maximum particle length greater than 25 μm is 30 μm or more and 80 μm or less.

2 Claims, 4 Drawing Sheets

(56) References Cited

FOREIGN PATENT DOCUMENTS

| | | | | |
|---|---|---|---|---|
| JP | S53-043027 | A | 4/1978 | |
| JP | 2011-256414 | A | 12/2011 | |
| JP | 2017-052944 | A | 3/2017 | |
| WO | 2016/056362 | A1 | 4/2016 | |
| WO | WO-2016056362 | A1 * | 4/2016 | ..... C21B 13/10 |
| WO | 2016/190023 | A1 | 12/2016 | |
| WO | 2018/194165 | A1 | 10/2018 | |

OTHER PUBLICATIONS

Notice of Reasons for Rejection dated Aug. 28, 2018, issued to JP Application No. 2017-103028 and an English machine translation thereof.

Notice of Decision to Grant a Patent dated Oct. 23, 2019, issued to JP Application no. 2017-103028 and an English machine translation thereof.

International Search Report dated Jun. 5, 2018, issued for PCT/JP2018/018395.

* cited by examiner

METHOD FOR SMELTING OXIDE ORE

TECHNICAL FIELD

The present invention relates to a method for smelting an oxide ore, and for example, relates to a method for smelting an oxide ore of obtaining a reduced product such as ferronickel by smelting a pellet produced from an oxide ore such as a nickel oxide ore, and a reducing agent by performing reduction and heating at a high temperature in a reducing furnace.

BACKGROUND ART

A dry smelting method for producing a nickel mat by using a smelting furnace, a dry smelting method for producing ferronickel that is an alloy of iron and nickel by using a rotary kiln or a movable hearth furnace, a wet smelting method for producing mixed sulfide by using an autoclave, and the like are known as a method for smelting a nickel oxide ore referred to as limonite or saprolite that is one type of oxide ore.

In various methods described above, in particular, in a case where the nickel oxide ore is reduced and smelted by using the dry smelting method, in order to advance a reaction, a treatment of forming a lump product by crushing the nickel oxide ore that is a raw material to have a suitable size is performed as a pretreatment.

Specifically, when a nickel oxide ore is formed into a lump product, that is, a powder-like ore or a fine-grained ore is formed into a lump-like ore, it is general that the nickel oxide ore, and other components, for example, a binder and a reducing agent such as a coke are mixed to be a mixture, the mixture is subjected to moisture adjustment or the like, and then, is put into a lump product producing machine, and for example, a lump product of which one side or a diameter is approximately 10 mm~30 mm (indicating a pellet, a briquette, and the like, and hereinafter, will be simply referred to as a "pellet").

It is necessary that the pellet obtained by being formed into the lump product has a certain degree of aeration properties in order to "drain" the contained moisture. Further, in the subsequent reduction treatment, in a case where the reduction is not homogeneously advanced in the pellet, the composition of a reduced product to be obtained is inhomogeneous, and a problem that a metal is dispersed or unevenly distributed occurs. For this reason, it is important to homogeneously mix the mixture at the time of preparing the pellet, or to maintain a homogeneous temperature to a maximum extent at the time of reducing the obtained pellet.

In addition, coarsening a metal (ferronickel) that is generated by the reduction treatment is also an extremely important technology. In a case where ferronickel that is generated, for example, has a fine size of several tens of μm to several hundreds of μm, it is difficult to separate ferronickel from a slag that is simultaneously generated, and a recovery rate (a yield) as ferronickel greatly decreases. For this reason, a treatment for coarsening ferronickel after the reduction is necessary.

In addition, it is also an important technical matter how a smelting cost can be suppressed to be low, and a continuous treatment that can be operated in a compact facility is desirable.

For example, in Patent Document 1, a method for producing a granular metal of supplying an agglomerated product containing a metal oxide and a carbonaceous reducing agent onto a hearth of a moving bed type reduction melting furnace, of performing heating, and performing reduction melting with respect to the metal oxide, in which when a relative value of a projected area ratio of a hearth of an agglomerated product with respect to a maximum projected area ratio of a hearth of an agglomerated product at the time of setting a distance between the agglomerated products to 0 is set to a base density, an agglomerated product having an average diameter of 19.5 mm~32 mm is supplied onto the hearth such that the base density is 0.5~0.8, and is heated, is disclosed. In Patent Document 1, it is described that it is possible to increase the productivity of granular metal iron by controlling the base density and the average diameter of the agglomerated product together, in the method.

However, the method disclosed in Patent Document 1 is a technology for controlling a reaction occurring outside the agglomerated product, and does not focus on the control of a reaction occurring in the agglomerated product which is the most important factor in the reduction reaction. On the other hand, it is required to increase a reaction efficiency by controlling the reaction occurring in the agglomerated product, and to obtain a higher quality metal (a metal and an alloy) by more homogeneously advancing the reduction reaction.

In addition, as with Patent Document 1, in a method using an agglomerated product having a specific diameter as the agglomerated product, it is necessary to remove an agglomerated product not having a specific diameter, and thus, a yield at the time of preparing the agglomerated product decreases. In addition, in the method of Patent Document 1, it is necessary to adjust the base density of the agglomerated product to be 0.5~0.8, and it is not possible to laminate the agglomerated product, and thus, the productivity is low. As described above, in the method in Patent Document 1, a production cost is high.

Further, as with Patent Document 1, in a process using a so-called total melting method in which all raw materials are melted and reduced, there is a major problem on an operation cost. For example, in order to completely melt a nickel oxide ore that is a raw material, a high temperature of 1500° C. or higher is necessary, but a considerable energy cost is required for such a high temperature condition, and a furnace that is used at such a high temperature is easily damaged, and thus, a repair cost is also required. Further, only approximately 1% of nickel is contained in the nickel oxide ore that is the raw material, and thus, even though it is not necessary to recovery other than iron corresponding to nickel, all components that are contained in large amounts and are not required to be recovered are melted, which is extremely inefficient.

Therefore, a reduction method of partial melting has been considered in which only necessary nickel is reduced, but iron that is contained in larger amounts than nickel is partially reduced. However, in such a partial reduction method (or also referred to as a nickel preferential reduction method), a reduction reaction is performed while a raw material is maintained in a semi-solid state where the raw material is not completely melted, and thus, it is not easy to control the reaction such that the reduction of iron is within a range corresponding to nickel while 100% of nickel is completely reduced. Accordingly, there is a problem that a partial variation in the reduction of the raw material occurs, and efficient operation is difficult due to a decrease in a nickel recovery rate.

As described above, in a technology of producing a metal or an alloy by mixing and reducing an oxide ore, there are many problems in increasing the productivity or the efficiency, reducing the production cost, and increasing the quality of the metal by homogeneously advancing the reduction reaction.

Patent Document 1: Japanese Unexamined Patent Application, Publication No. 2011-256414

DISCLOSURE OF THE INVENTION

Problems to be Solved by the Invention

The present invention has been proposed in consideration of such circumstances, and an object thereof is to provide a smelting method of producing a metal by reducing a mixture containing an oxide ore such as an nickel oxide ore and a carbonaceous reducing agent, in which it is possible to produce a high-quality metal with high productivity or high efficiency at a low production cost.

Means for Solving the Problems

The present inventors have conducted intensive studies for solving the problems described above. As a result thereof, it has been found that a carbonaceous reducing agent is composed of particles (reducing agent particles) in which the number of reducing agent particles having a maximum particle length of 25 μm or less is 2%~25% with respect to the total number of reducing agent particles, and an average maximum particle length with respect to reducing agent particles having a maximum particle length of greater than 25 μm is 30 μm~80 μm, a metal oxide is reduced by the carbonaceous reducing agent, and a reduced product is obtained, and thus, aggregation or uneven distribution of the carbonaceous reducing agent in the mixture is suppressed, and therefore, a contact area between the oxide ore and the carbonaceous reducing agent, and the homogeneity of the mixture increase, and the present invention has been completed. That is, the present invention provides the followings.

(1) A first invention of the present invention is a method for smelting an oxide ore of obtaining a metal that is a reduced product and a slag by mixing an oxide ore and a carbonaceous reducing agent, and by performing heating for a reduction treatment with respect to a mixture that is obtained, in which the carbonaceous reducing agent is composed of particles (reducing agent particles), a ratio of the number of reducing agent particles which are contained in the carbonaceous reducing agent and have a maximum particle length of 25 μm or less is 2% or more and 25% or less of the total number of reducing agent particles contained in the carbonaceous reducing agent, and an average maximum particle length of reducing agent particles having a maximum particle length of greater than 25 μm that is obtained by Expression (1) described below is 30 μm or more and 80 μm or less.

Average Maximum Particle Length=Sum of Maximum Particle Length of 300 Reducing Agent Particles/300 Expression (1)

(2) A second invention of the present invention is a method for smelting an oxide ore, in which in the first invention, a reduction temperature in the reduction treatment is 1200° C. or more and 1450° C. or less.

(3) A third invention of the present invention is a method for smelting an oxide ore, in which in the first invention or the second invention, the oxide ore is a nickel oxide ore.

(4) A fourth invention of the present invention is a method for smelting an oxide ore, in which in any one of the first invention to the third invention, the metal is ferronickel.

Effects of the Invention

According to the present invention, it is possible to provide a smelting method of producing a metal by reducing a mixture containing an oxide ore and a carbonaceous reducing agent, in which it is possible to produce a high-quality metal with high productivity or high efficiency at a low production cost.

PREFERRED MODE FOR CARRYING OUT THE INVENTION

Figure 1:
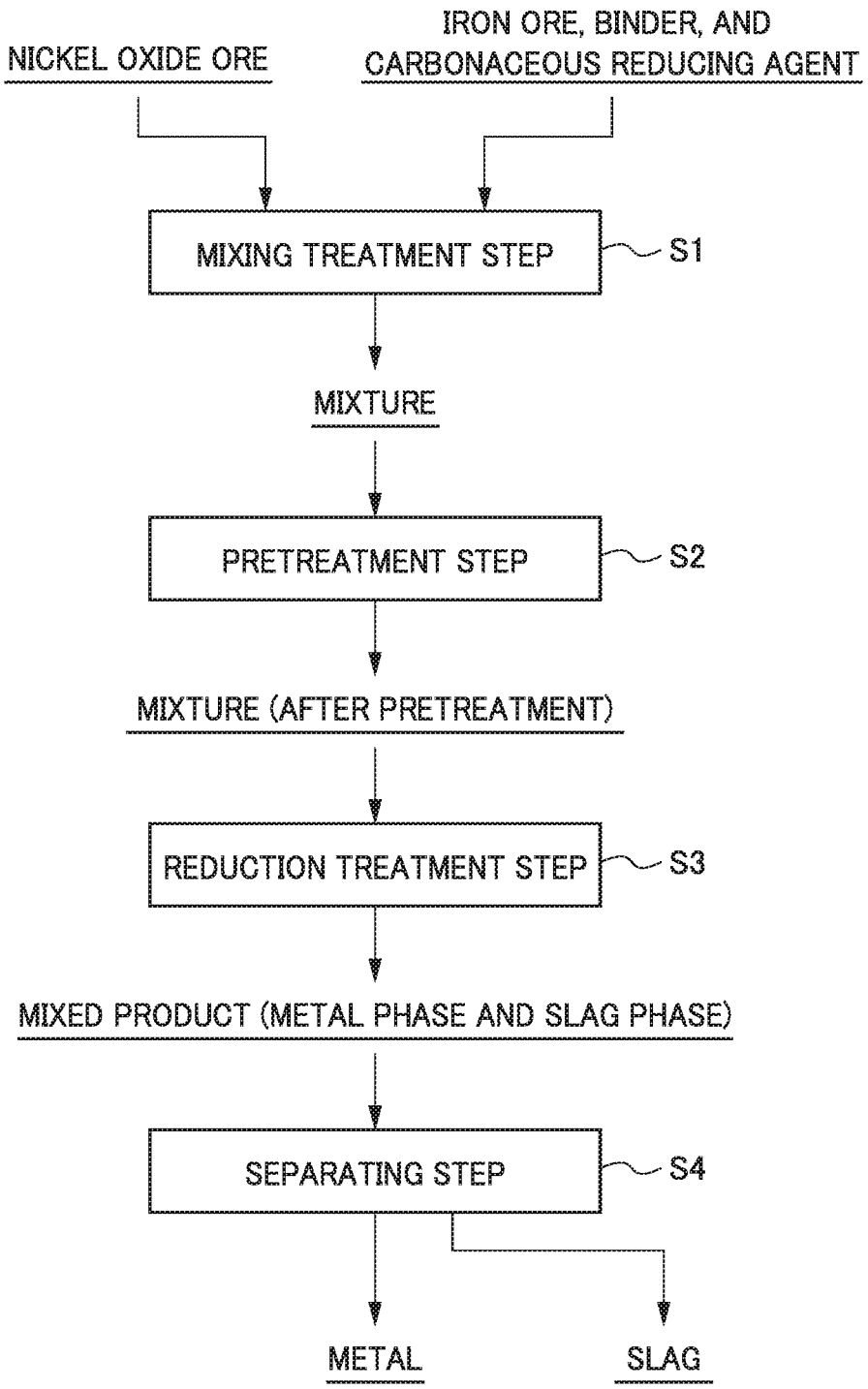
FIG. 1 is a process drawing illustrating an example of a flow of a method for smelting an oxide ore.

Hereinafter, a specific embodiment of the present invention will be described in detail. Furthermore, the present invention is not limited to the following embodiment, and various changes can be performed within a range not departing from the gist of the present invention. In addition, herein, a notation of "X~Y" (X and Y are an arbitrary numerical value) indicates "greater than or equal to X and less than or equal to Y".

<<1. Outline of Present Invention>>

A method for smelting an oxide ore according to the present invention is a method in which an oxide ore is a raw material, the oxide ore and a carbonaceous reducing agent are mixed to be a mixture, the obtained mixture is subjected to a reduction treatment at a high temperature, and thus, a metal that is a reduced product is produced. For example, a method is exemplified in which a nickel oxide ore containing nickel oxide, iron oxide, or the like is a raw material, as the oxide ore, the nickel oxide ore and the carbonaceous reducing agent are mixed, nickel contained in the mixture is preferentially reduced at a high temperature, and iron is partially reduced, and thus, ferronickel that is an alloy of iron and nickel is produced.

Specifically, the method for smelting an oxide ore according to the present invention is a method of obtaining a metal that is a reduced product and a slag by mixing an oxide ore and a carbonaceous reducing agent, and by performing heating for a reduction treatment with respect to a mixture that is obtained, as a raw material, the carbonaceous reducing agent is composed of particles (hereinafter, also referred to as "reducing agent particles") in which an average maximum particle length of reducing agent particles having a maximum particle length of greater than 25 μm that is obtained by Expression (1) described below is 30 μm or more and 80 μm or less, and a ratio of the number of reducing agent particles which are contained in the carbonaceous reducing agent and have a maximum particle length of 25 μm or less is 2% or more and 25% or less of the total number of reducing agent particles contained in the carbonaceous reducing agent.

Average Maximum Particle Length=Sum of Maximum Particle Length of 300 Reducing Agent Particles/300 Expression (1)

According to such a smelting method, it is possible to increase a contact area between the oxide ore and the carbonaceous reducing agent, and to easily advance the reduction reaction of the oxide ore. In addition, aggregation or uneven distribution of the carbonaceous reducing agent is suppressed as the dispersibility of the carbonaceous reducing agent in the mixture increases, and thus, it is possible to homogeneously advance the reduction reaction. Accordingly, it is possible to produce a high quality metal with high productivity or high efficiency at a low production cost.

Hereinafter, a method for smelting a nickel oxide ore will be described as an example of a specific embodiment of the present invention (hereinafter, referred to as "this embodiment"). As described above, the nickel oxide ore that is a smelting raw material contains at least nickel oxide (NiO) and iron oxide ($Fe_2O_3$), and the nickel oxide ore is subjected to the reduction treatment as the smelting raw material, and thus, an iron-nickel alloy (ferronickel) can be produced as the metal.

Furthermore, in the present invention, the oxide ore is not limited to the nickel oxide ore, and the smelting method is not limited to a method of producing ferronickel from the nickel oxide ore containing a nickel oxide or the like.

<<2. Method for Smelting Nickel Oxide Ore>>

The method for smelting a nickel oxide ore according to this embodiment is a method of generating ferronickel that is a metal, as the reduced product, and the slag, by mixing the nickel oxide ore and the carbonaceous reducing agent to be a mixture, and by performing the reduction treatment with respect to the mixture. In the smelting method, nickel (nickel oxide) in the mixture is preferentially reduced, and iron (iron oxide) is partially reduced, and thus, ferronickel is generated. Furthermore, ferronickel that is a metal can be recovered by separating the metal from the mixture containing the metal and the slag that are obtained through the reduction treatment.

FIG. 1 is a process drawing illustrating an example of a flow of a method for smelting a nickel oxide ore. As illustrated in FIG. 1, the smelting method includes a mixing treatment step S1 of mixing a nickel oxide ore and a carbonaceous reducing agent, a reduction pretreatment step S2 of molding by forming the obtained mixture into a lump or filling the obtained mixture into a predetermined vessel, a reduction treatment step S3 of heating the mixture that is formed into a lump or filled into the vessel at a predetermined temperature (a reduction temperature), and a separating step S4 of separating and recovering a metal from the mixture (mixed product) containing the metal and the slag that are generated in the reduction treatment step S3.

<1. Mixing Treatment Step>

The mixing treatment step S1 is a step of obtaining the mixture by mixing a raw material powder containing the nickel oxide ore. Specifically, in the mixing treatment step S1, the carbonaceous reducing agent is added into and mixed with the nickel oxide ore that is a raw material ore, and, for example, a powder having a particle diameter of approximately 0.1 mm 0.8 mm, such as an iron ore, a flux component, and a binder, is added and mixed, as an additive of an arbitrary component, and thus, the mixture is obtained. Furthermore, the mixing treatment can be performed by using a mixing machine or the like.

(Nickel Oxide Ore)

The nickel oxide ore that is the raw material ore is not particularly limited, and a limonite ore, a saprolite ore, and the like can be used as the nickel oxide ore. Furthermore, the nickel oxide ore contains at least nickel oxide (NiO) and iron oxide ($Fe_2O_3$).

(Carbonaceous Reducing Agent)

The carbonaceous reducing agent is not particularly limited, and a coal powder, a coke powder, and the like are exemplified.

In this embodiment, the carbonaceous reducing agent is composed of the particles (the reducing agent particles), in which the average maximum particle length of the reducing agent particles having the maximum particle length of greater than 25 μm is greater than or equal to 30 μm and less than or equal to 80 μm. In addition, in the carbonaceous reducing agent, the ratio of the number of reducing agent particles which are contained in the carbonaceous reducing agent and have the maximum particle length of 25 μm or less is 2% or more and 25% or less of the total number of reducing agent particles contained in the carbonaceous reducing agent. That is, the carbonaceous reducing agent contains the reducing agent particles having the maximum particle length of 25 μm or less and the reducing agent particles having the maximum particle length of greater than 25 μm.

Figure 2:
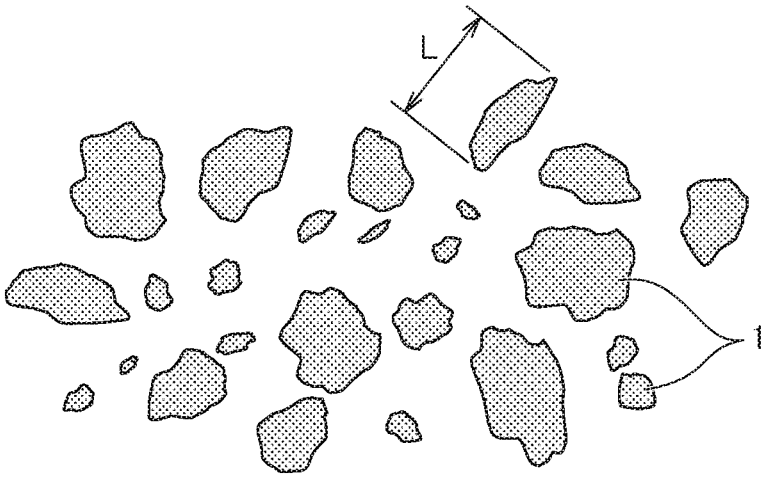
FIG. 2 is a plan view illustrating an example of a shape and a distribution of a carbonaceous reducing agent.

Here, the "maximum particle length" of the reducing agent particles is the longest side or diameter in the reducing agent particles. Specifically, for example, in a case where the reducing agent particles are in the shape of an ellipse, the maximum particle length is a long diameter, and in a case where the reducing agent particles are in the shape of a rectangular parallelepiped, the maximum particle length is a diagonal line. FIG. 2 is a schematic view illustrating a maximum particle length of amorphous particles, and a maximum particle length T can be measured by using a metal microscope.

In addition, the "average maximum particle length" of the reducing agent particles is an average value of the maximum particle length T in a number average of 300 reducing agent particles that are randomly selected, and is obtained by Expression (1) described below.

$$\text{Average Maximum Particle Length} = \text{Sum of Maximum Particle Length of 300 Reducing Agent Particles}/300 \quad \text{Expression (1)}$$

In particular, the carbonaceous reducing agent containing the fine reducing agent particles having the maximum particle length of 25 μm or less is used, and thus, a contact area between the nickel oxide ore and the carbonaceous reducing agent increases, and it is possible to easily advance the reduction reaction of the nickel oxide ore. Accordingly, the dispersibility in the mixture increases, and the aggregation or the uneven distribution of the carbonaceous reducing agent is suppressed, and thus, it is possible to homogeneously advance the reduction reaction.

More specifically, in the average maximum particle length of the reducing agent particles that are contained in the carbonaceous reducing agent, the average maximum particle length of the reducing agent particles having the maximum particle length of greater than 25 μm is 30 μm or greater. In a case where the average maximum particle length is excessively small, the ratio of fine reducing agent particles excessively increase, and thus, the carbonaceous reducing agent is aggregated or unevenly distributed. For this reason, it is difficult to obtain a homogeneous mixture, and thus, it is difficult to homogeneously advance the reduction reaction.

The average maximum particle length of the reducing agent particles having the maximum particle length of greater than 25 μm is 80 μm or less, and is more preferably 60 μm or less. In a case where the average maximum particle length is excessively large, the ratio of coarse reducing agent particles excessively increase, and thus, the dispersibility of the carbonaceous reducing agent in the mixture is degraded. For this reason, it is difficult to obtain a homogeneous mixture, and it is difficult to homogeneously advance the reduction reaction.

In addition, the ratio of the number of reducing agent particles that are contained in the carbonaceous reducing agent, the ratio of the number of reducing agent particles having the maximum particle length of 25 μm or less is 2% or greater, and is more preferably 3% or greater with respect to the total number of reducing agent particles of the carbonaceous reducing agent. In a case where the ratio of the reducing agent particles having the maximum particle length of 25 μm or less is extremely small, the fine reducing agent particles excessively decrease, and it is difficult to homogeneously mix the carbonaceous reducing agent and the nickel oxide ore in the mixture, and thus, it is difficult to homogeneously advance the reduction reaction.

The ratio of the particles having the maximum particle length of 25 μm or less with respect to the total number of reducing agent particles of the carbonaceous reducing agent is 25% or less, and is more preferably 20% or less. In a case where the ratio of the reducing agent particles having the maximum particle length of 25 μm or less is excessively large, the ratio of the fine reducing agent particles excessively increases, and thus, the carbonaceous reducing agent is aggregated or unevenly distributed. For this reason, it is rather the more difficult to obtain a homogeneous mixture, and thus, it is difficult to homogeneously advance the reduction reaction.

As described above, the carbonaceous reducing agent to be added into the raw material ore is composed of the particles (the reducing agent particles) in which the average maximum particle length of the reducing agent particles having the maximum particle length of greater than 25 μm is 30 μm or more and 80 μm or less, and the ratio of the number of reducing agent particles which are contained in the carbonaceous reducing agent and have the maximum particle length of 25 μm or less is 2% or more and 25% or less of the total number of reducing agent particles of the carbonaceous reducing agent, and thus, it is possible to homogeneously mix the carbonaceous reducing agent and the nickel oxide ore in the mixture, and to increase the contact area between the nickel oxide ore and the carbonaceous reducing agent. Accordingly, in the reduction treatment step S3 described below, it is possible to more efficiently realize homogeneous reduction, and as a result thereof, it is possible to shorten a reaction time, to decrease the production cost, and to further increase the quality of ferronickel to be obtained.

When the total value (for convenience, also referred to as the "total value of a chemical equivalent") of both of a chemical equivalent necessary for reducing the total amount of nickel oxide composing the nickel oxide ore to nickel metal, and a chemical equivalent necessary for reducing iron oxide (ferric oxide) to metal iron is set to 100 mass %, a mixed amount of the carbonaceous reducing agent in the mixture, that is, the amount of carbonaceous reducing agent to be contained in the mixture can be adjusted such that the ratio of the amount of carbon is preferably 5 mass % or more and 60 mass % or less, and is more preferably 10 mass % or more and 40 mass % or less. The mixed amount of the carbonaceous reducing agent is set to have a ratio of 5 mass % or greater with respect to 100 mass % of the total value of the chemical equivalent, and thus, it is possible to efficiently advance the reduction of nickel, and the productivity is improved. On the other hand, the mixed amount of the carbonaceous reducing agent is set to have a ratio of 60 mass % or less with respect to 100 mass % of the total value of the chemical equivalent, and thus, it is possible to suppress a reduction amount of iron, to prevent a decrease in nickel quality, and to produce high quality ferronickel.

As described above, it is preferable that the mixed amount of the carbonaceous reducing agent is set to have the ratio of the amount of carbon of 5 mass % or more and 60 mass % or less with respect to 100 mass % of the total value of the chemical equivalent, and thus, it is possible to improve the productivity by homogeneously generating a shell (a metal shell) generated of a metal component on the surface of the mixture, and to obtain high quality ferronickel having high nickel quality.

(Iron Ore)

An iron ore can be added as an arbitrary component for adjusting an iron-nickel ratio in the mixture, in addition to the nickel oxide ore and the carbonaceous reducing agent. Here, the iron ore is not particularly limited, and for example, iron ore having iron quality of approximately 50% or greater, hematite obtained by performing wet smelting with respect to a nickel oxide ore, or the like can be used as the iron ore.

(Binder and Flux Component)

In addition, examples of the binder are capable of including bentonite, polysaccharide, a resin, liquid glass, a dehydrated cake, and the like. In addition, examples of the flux component are capable of including calcium oxide, calcium hydroxide, calcium carbonate, silicon dioxide, and the like.

In Table 1 described below, an example of the composition (weight %) of a part of the raw material powder that is mixed in the mixing treatment step S1 is shown. Furthermore, the composition of the raw material powder is not limited thereto.

TABLE 1

| Raw material [% by weight] | Ni | $Fe_2O_3$ | C |
|---|---|---|---|
| Nickel oxide ore | 1~2 | 50~60 | — |
| Iron ore | — | 80~95 | — |

In the mixing treatment step S1, the raw material powder containing the nickel oxide ore as described above is homogeneously mixed, and thus, the mixture is obtained. In the mixing, the raw material powder may be kneaded. Here, the raw material powder may be kneaded while being mixed, or may be kneaded after being mixed. Accordingly, a shear force is applied to the mixture, the raw material powder containing a carbon reducing agent is disaggregated, and is more homogeneously mixed, and thus, a contact area between the raw material powders increases, a void included in the mixture decreases, and the adhesiveness of each of the particles increases. Therefore, it is possible to shorten the reaction time of the reduction reaction, and to reduce a variation in the quality. Accordingly, it is possible to perform the treatment with high productivity, and to produce high quality ferronickel.

In addition, the mixture may be extruded by using an extruding machine after the raw material powder is kneaded. As described above, the mixture is extruded by the extruding machine, and thus, a higher kneading effect is obtained, and therefore, the contact area between the raw material powders increases, and the void included in the mixture decreases. For this reason, it is possible to more efficiently produce high quality ferronickel.

<2. Reduction Pretreatment Step (Pretreatment Step)>

The reduction pretreatment step S2 is a step of molding the mixture containing the nickel oxide ore and the carbonaceous reducing agent that is obtained in the mixing treatment step S1, and of drying the mixture, as necessary. That is, in the reduction pretreatment step S2, the mixture that is obtained by mixing the raw material powder is molded to be easily input into a furnace that is used in the reduction treatment step S3 described below, and to efficiently cause the reduction reaction.

(1) Molding of Mixture

In a case where the obtained mixture is molded, the mixture may be subjected to lumping (pelletization) and may be formed into a lump-like molded body (a pellet, a briquette, and the like), or a vessel or the like may be filled with the mixture to be a mixture filling vessel.

(Lumping of Mixture)

Among that, in a case where the mixture is subjected to lumping, a predetermined amount of moisture necessary for lumping is added into the mixture containing the nickel oxide ore and the carbonaceous reducing agent, and the mixture is molded into a lump-like molded body such as a pellet and a briquette (hereinafter, may be simply referred to as a "pellet") using, for example, a lump product producing device (a tumbling granulator, a compression molding machine, an extrusion molding machine, or the like, also referred to as a pelletizer).

A molding shape of the mixture, that is, the shape of a pellet is not particularly limited, and can be the shape of a cube, a rectangular parallelepiped, a cylinder, or a sphere. Among them, it is particularly preferable that the mixture is molded into a spherical pellet. The mixture is molded into the spherical pellet, and thus, it is possible to comparatively easily homogeneously advance the reduction reaction, and to suppress a cost for molding by facilitating the molding of the mixture. In addition, the shape of the pellet is simplified, and thus, it is possible to reduce a poorly molded pellet.

The size of the pellet that is obtained by the lumping (a diameter in the case of the spherical pellet) is not particularly limited, and for example, can be approximately 10 mm~30 mm in the case of being subjected to a drying treatment in the pretreatment step S2, a drying treatment (a drying step S31) in the reduction treatment step S3, or a preheating treatment (a preheating step S32), and a reduction treatment (a reducing step S33). Furthermore, the reduction treatment step S3 or the like will be described below in detail.

(Filling of Vessel with Mixture)

On the other hand, in a case where the mixture is filled into a vessel or the like and is molded, the mixture containing the nickel oxide ore and the carbonaceous reducing agent is filled into a predetermined vessel or the like while being kneaded with an extruding machine or the like, and thus, it is possible to obtain the mixture filling vessel. The obtained mixture filling vessel may be used as it is in the reduction treatment step S3 that is the next step, and it is more preferable that the mixture contained in the vessel or the like is packed by a press or the like, and is used in the reduction treatment step S3. In particular, the mixture contained in the vessel or the like is packed and molded, and the molded mixture is applied to the reduction treatment step S3 that is the next step, and thus, it is possible to increase a density by reducing a void generated in the mixture, and to more easily homogeneously advance the reduction reaction by homogenizing the density. Therefore, it is possible to prepare ferronickel having a smaller variation in the quality.

The shape of the mixture filling vessel is not particularly limited, and for example, the shape of a rectangular parallelepiped, a cube, a cylinder, and the like is preferable. In addition, the size of the mixture filling vessel is not particularly limited, and for example, in the case of the shape of a rectangular parallelepiped or a cube, in general, it is preferable that the inside dimension of the vertical, the horizontal, and the height are 500 mm or less, respectively. According to such a shape and such a size, it is possible to perform smelting with a small variation in the quality and high productivity.

(2) Drying Treatment of Mixture

The mixture containing the nickel oxide ore and the carbonaceous reducing agent may be subjected to the drying treatment at least before or after the mixture is molded. Here, there is a case where the mixture containing the nickel oxide ore and the carbonaceous reducing agent contains a lot of moisture, and in a case where the temperature of such a mixture rapidly increases to the reduction temperature, there is a case where the moisture is gasified at once, and swells, and thus, the mixture is broken. In addition, there are many cases where the mixture is in a sticky state due to the moisture.

Therefore, the drying treatment is performed with respect to the mixture, and for example, a solid content of the lump product is approximately 70 mass %, and the moisture is approximately 30 mass %, and thus, in the reduction treatment step S3 that is the next step, it is possible to prevent the mixture from being broken, and to prevent the ejection of the mixture from reducing furnace from being difficult due to the breakage of the mixture. In addition, the drying treatment is performed with respect to the mixture, and thus, it is possible to resolve the sticky state of the surface, and thus, it is possible to facilitate the handling of the mixture until being put into the reducing furnace.

Specifically, the drying treatment with respect to the mixture is not particularly limited, and for example, the mixture is dried by blowing hot air of 200° C.~400° C. with respect to the mixture. Furthermore, it is preferable that the temperature of the mixture at the time of performing the drying treatment is maintained to be lower than 100° C., from the viewpoint of making the pellet difficult to be broken.

The drying treatment may be performed only once including the drying treatment (the drying step S31) in the reduction treatment step S3 described below, or may be performed a plurality of times. Furthermore, in a case where the drying treatment is performed only once, as described below, the drying step S31 is performed in the reduction treatment step S3, and thus, it is possible to further increase an energy efficiency.

In Table 2 described below, an example of the composition (parts by weight) of the solid content in the pellet after the drying treatment is shown. Furthermore, the composition of the pellet is not limited thereto.

TABLE 2

| Composition of solid content in pellet after drying [Parts by weight] | | | | | | | |
|---|---|---|---|---|---|---|---|
| Ni | $Fe_2O_3$ | $SiO_2$ | CaO | $Al_2O_3$ | MgO | Binder | Others |
| 0.5~1.5 | 50~60 | 8~15 | 4~8 | 1~6 | 2~7 | Approximately 1 | Residue |

<3. Reduction Treatment Step>

In the reduction treatment step S3, the mixture that is molded through the reduction pretreatment step S2 is put into the reducing furnace, and is reduced and heated at a predetermined reduction temperature. As described above, the heating treatment is performed with respect to the mixture, and thus, a smelting reaction (the reduction reaction) is advanced, and a mixed product of the metal and the slag is generated.

Figure 3:
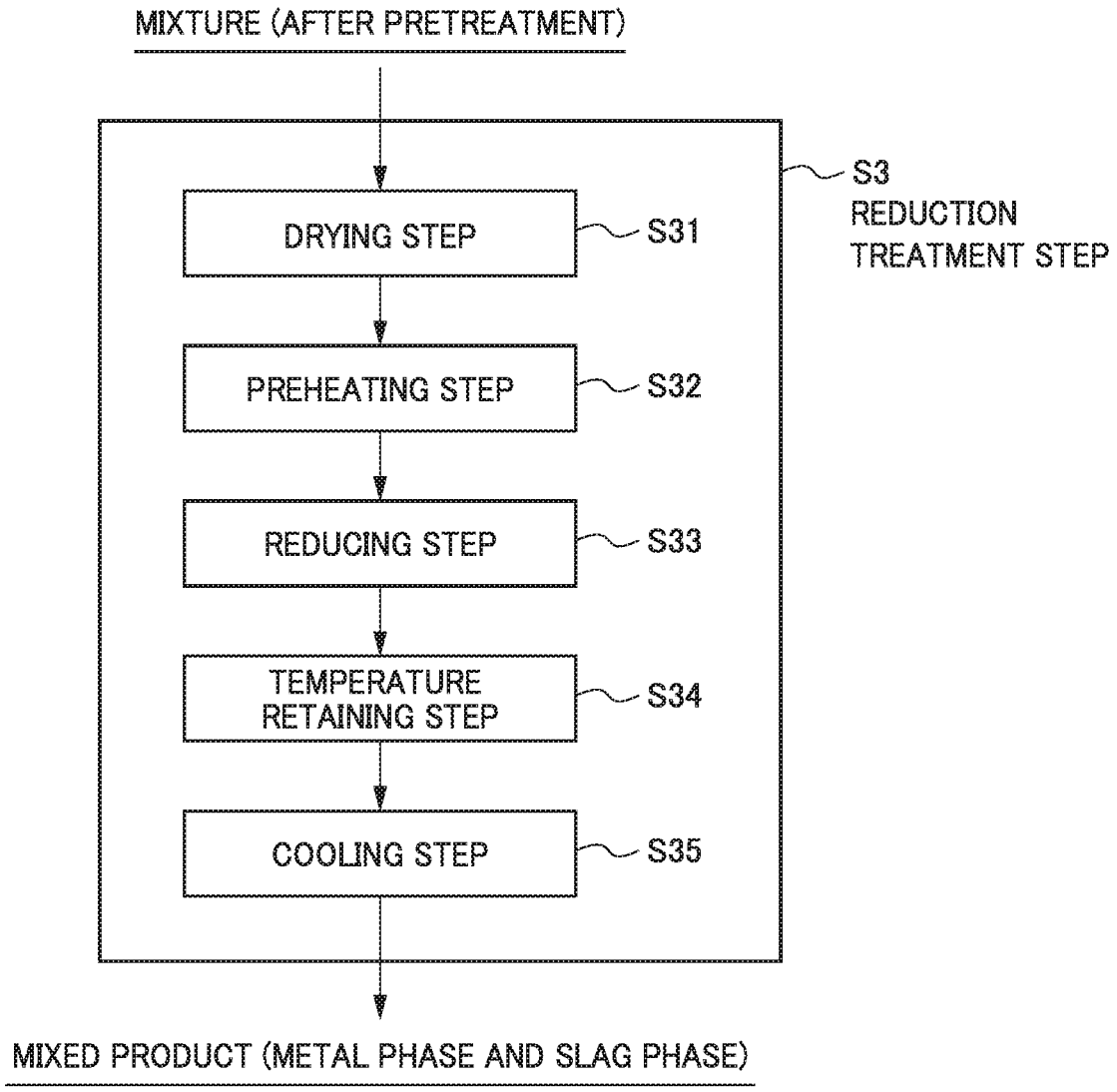
FIG. 3 is a treatment flow diagram illustrating an example of a flow of a treatment in a reduction treatment step.

FIG. 3 is a process drawing illustrating a treatment step that is executed in the reduction treatment step S3. As illustrated in FIG. 3, the reduction treatment step S3 includes the drying step S31 of drying the mixture, the preheating step S32 of preheating the dried mixture, the reducing step S33 of heating for reducing the mixture, and a cooling step S35 of cooling the obtained reduced product. In addition, the reduction treatment step S3 may include a temperature retaining step S34 of retaining the reduced product obtained through the reducing step S33 in a predetermined temperature range.

Here, a reduction heating treatment in the reduction treatment step S3 is performed by using a reducing furnace or the like. The reducing furnace used in the reduction heating treatment is not particularly limited, and it is preferable that a movable hearth furnace is used as the reducing furnace. By using the movable hearth furnace as the reducing furnace, the mixture can be placed on the hearth outside the furnace, and then, can be put into the movable hearth furnace, and thus, it is possible to more efficiently operate the reducing furnace. In addition, the reduction reaction is continuously advanced by using the movable hearth furnace, and thus, it is possible to complete the reaction in one facility, and to accurately control the treatment temperature compared to the case of using a separate furnace in the treatment of each of the steps. Further, it is possible to reduce a heat loss and to accurately control the atmosphere in the furnace by performing each of the treatments in one facility with the movable hearth furnace, and thus, it is possible to more effectively advance the reaction. For this reason, it is possible to more effectively obtain an iron-nickel alloy having high nickel quality.

Figure 4:
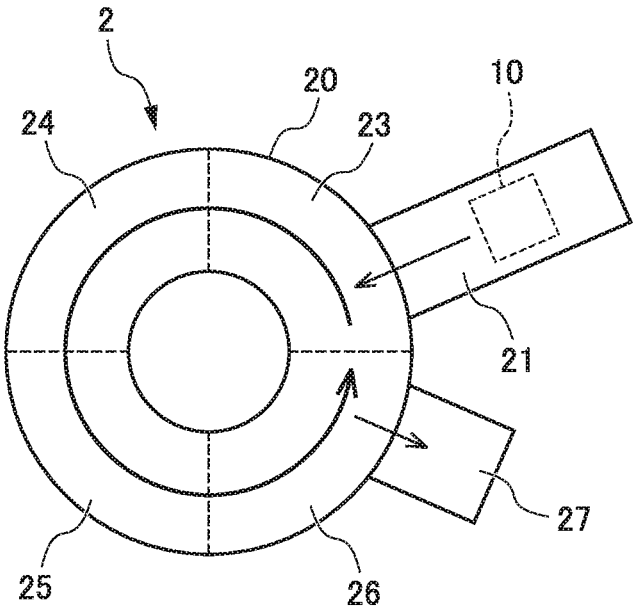
FIG. 4 is a diagram (a plan view) illustrating a composition example of a rotary hearth furnace of which a hearth is rotated.

The movable hearth furnace is not particularly limited, and a rotary hearth furnace, a roller hearth kiln, or the like can be used as movable hearth furnace. Among them, examples of the case of using the rotary hearth furnace are capable of including a reducing furnace 2 includes a rotary hearth furnace (a rotary hearth furnace) 20 that is in the shape of a circle and is divided into a plurality of treatment chambers 23 to 26, as illustrated in FIG. 4. The rotary hearth furnace 20 includes a hearth that performs rotary movement on the plane, and the hearth on which the mixture is placed performs the rotary movement in a predetermined direction, and thus, each of the treatments is performed in each region. At this time, it is possible to adjust the treatment temperature in each of the regions by controlling a time (a movement time and a rotation time) at the time of passing through each of the regions, and a mixture 10 is subjected to the smelting treatment every time when a rotary hearth is rotated once.

In the rotary hearth furnace 20, for example, all of the treatment chambers 23 to 26 may be used as a reduction chamber, and the reduction treatment may be performed with respect to the mixture 10 that is sequentially supplied from a drying chamber 21, in the treatment chambers 23 to 26. On the other hand, the treatment chamber 23 may be used as a preheating chamber, the treatment chamber 24 may be used as a reduction chamber, the treatment chamber 25 may be used as a temperature retaining chamber, and the treatment chamber 26 may be used as a cooling chamber, the mixture 10 that is sequentially supplied from the drying chamber 21 may be subjected to preheating in the treatment chamber 23, and may be subjected to the reduction treatment in the treatment chamber 24, the temperature of the mixture 10 may be retained in the treatment chamber 25, and then, may be cooled in the treatment chamber 26, and the mixture 10 may be further subjected to the cooling treatment in an external cooling chamber 27. As described above, in the case of changing a temperature in the treatment chambers 23 to 26, it is preferable that the treatment chambers 23 to 26 are partitioned by a movable partition wall, in order to suppress an energy loss by strictly controlling the reaction temperature. Furthermore, an arrow on the rotary hearth furnace 20 in FIG. 4 indicates a rotation direction of the hearth, and indicates a movement direction of a treated product (the mixture).

The treatments are performed in one reducing furnace by using the rotary hearth furnace 20, and thus, it is possible to maintain the temperature in the reducing furnace at a high temperature, and therefore, it is not necessary to increase or decrease the temperature every time when the treatment in each of the steps is performed, and it is possible to reduce an energy cost. For this reason, it is possible to continuously and stably prepare ferronickel having excellent quality with high productivity.

Furthermore, in particular, in a case where the mixture is put into the reducing furnace, the carbonaceous reducing agent (hereinafter, also referred to as a "hearth carbonaceous reducing agent") may be spread in advance on the hearth of the reducing furnace, and the mixture may be placed on the spread hearth carbonaceous reducing agent. In addition, the vessel filled with the mixture can be placed on the hearth carbonaceous reducing agent, and then, can be in a state of being covered with the carbonaceous reducing agent. As described above, the mixture is put into the reducing furnace in which the carbonaceous reducing agent is spread on the hearth, or the reduction heating treatment is performed in order to further cover the put mixture, in a state where the mixture is surrounded by the carbonaceous reducing agent, and thus, it is possible to more rapidly advance the smelting reaction while suppressing the breakage of the mixture. In addition, in particular, the hearth carbonaceous reducing agent is spread, and thus, even in a case where the reduction reaction is advanced in the treatment chambers 23 to 26, and a nickel metal or a slag is generated, a reaction with the hearth is suppressed, and therefore, it is possible to prevent the slag from seeping into or being pasted to the hearth.

(1) Drying Step

In the drying step S31, the drying treatment is performed with respect to the mixture that is obtained by mixing the raw material powder. A main object of the drying step S31 is to drain moisture or crystalline water in the mixture.

The mixture that is obtained in the mixing treatment step S1 contains a lot of moisture or the like, and in a case where the mixture is rapidly heated to a high temperature such as the reduction temperature at the time of performing the reduction treatment in such a state, the moisture is gasified at once, and swells, and thus, the molded mixture is broken, and according to a case, is ruptured into pieces, and therefore, it is difficult to perform a homogeneous reduction treatment. Therefore, the moisture is removed by performing the drying treatment with respect to the mixture before the reduction treatment is performed, and thus, it is possible to prevent the breakage of the mixture, and to accelerate a homogeneous reduction treatment.

It is preferable that the drying treatment in the drying step S31 is performed in a state of being connected to the reducing furnace. On the other hand, it is also considered that the drying treatment is performed by providing an area of performing the drying treatment in the reducing furnace (a drying area), but in such a case, the drying treatment in the drying area is subjected to rate controlling, and thus, there is a possibility that a treatment efficiency in the reducing step S33 or a treatment efficiency in the temperature retaining step S34 decreases.

Therefore, it is preferable that the drying treatment in the drying step S31 is performed in the drying chamber that is provided outside the furnace in which the reduction reaction is performed, and is directly or indirectly connected to the furnace. For example, in the reducing furnace 2 of FIG. 4, the drying chamber 21 is provided outside the furnace of the rotary hearth furnace 20, and thus, it is possible to design the drying chamber completely separated from the preheating step, the reducing step, and the cooling step, described below, and it is possible to easily execute a desired drying treatment, a desired preheating treatment, a desired reduction treatment, and a desired cooling treatment, respectively. For example, in a case where a lot of moisture remains in the mixture in a manner that depends on the raw material, it takes time to perform the drying treatment, and thus, it is sufficient to design the total length of the drying chamber 21 to be longer, or to design a conveyance speed of the mixture 10 in the drying chamber 21 to be slower.

A method of the drying treatment in the drying step S31 is not particularly limited, and the drying treatment can be performed by blowing hot air with respect to the mixture 10 that has been conveyed to the drying chamber 21. In addition, a drying temperature of the drying chamber 21 is not particularly limited, and it is preferable that the drying temperature is 500° C. or lower from the viewpoint of preventing the reduction reaction from being started, and it is more preferable that the entire mixture 10 is homogeneously dried at a temperature of 500° C. or lower.

(2) Preheating Step

In the preheating step S32, the mixture after the moisture is removed by the drying treatment in the drying step S31 is preheated (preheated). A main object of the preheating step S32 is to smoothly increase a temperature at the time of performing the reduction to the reduction temperature.

When the mixture is put into the furnace in which the reduction reaction is performed from the outside, the temperature of the mixture rapidly increases to the reduction temperature, and thus, there is a case where the mixture is broken or is formed into a powder due to a thermal stress. In addition, the temperature of the mixture does not homogeneously increase, and thus, there is a case where a variation occurs in the reduction reaction, and the quality of a metal to be generated varies. For this reason, it is preferable that the preheating is performed to a predetermined temperature after the drying step S31 is performed with respect to the mixture, and thus, it is possible to suppress the breakage of the mixture or a variation in the reduction reaction.

The preheating treatment in the preheating step S32 may be performed in the preheating chamber that is provided in the rotary hearth furnace, or may be performed in the preheating chamber that is provided outside the rotary hearth furnace and is continuously provided from the drying chamber to the rotary hearth furnace through the preheating chamber. For example, in the reducing furnace 2 illustrated in FIG. 4, the treatment chamber 23 that is continuously provided from the drying chamber 21 in the rotary hearth furnace 20 is used as the preheating chamber, and thus, it is possible to maintain a temperature in the rotary hearth furnace 20 at a high temperature, and therefore, in the reducing step S33, it is possible to considerably reduce energy necessary for reheating the rotary hearth furnace 20 to which the mixture 10 is supplied.

A preheating temperature in the preheating step S32 is not particularly limited, and is preferably 600° C. or higher, and is more preferably 700° C. or higher. On the other hand, the upper limit of the preheating temperature in the preheating step S32 may be 1280° C. In particular, the treatment is performed at a high preheating temperature, and thus, in the reducing step S33, it is possible to considerably reduce the energy necessary at the time of reheating the rotary hearth furnace 20 to the reduction temperature.

(3) Reducing Step

In the reducing step S33, the reduction treatment is performed with respect to the mixture that is preheated in the preheating step S32 at a predetermined reduction temperature. A main object of the reducing step S33 is to reduce the mixture that is preheated in the preheating step S32.

In the reduction treatment in which the reducing furnace is used, it is preferable that nickel oxide that is a metal oxide contained in the nickel oxide ore is completely reduced to a maximum extent, whereas only a part of iron oxide derived from an iron ore or the like that is mixed with the nickel oxide ore as the raw material powder is reduced, and thus, ferronickel having desired nickel quality can be obtained.

The reduction temperature in the reducing step S33 is not particularly limited, and it is preferable that the reduction temperature is in a range of 1200° C. or more and 1450° C. or less. Here, the lower limit of the reduction temperature in the reducing step S33 is preferably 1200° C., and is more preferably 1300° C. In addition, the upper limit of the reduction temperature in the reducing step S33 is preferably 1450° C., and is more preferably 1400° C. The reduction reaction is easily homogeneously advanced by performing the reduction in such a temperature range, and thus, it is possible to generate a metal (ferronickel) in which a variation in the quality is suppressed. In addition, it is possible to advance a desired reduction reaction for a comparatively short period of time by performing the reduction in the temperature range.

A time for performing the reduction heating treatment in the reducing step S33 is set in accordance with the temperature of the reducing furnace, and is preferably 10 minutes or longer, and is more preferably 15 minutes or longer. On the other hand, the upper limit of the time for performing the reduction heating treatment in the reducing step S33 may be 50 minutes or shorter, or may be 40 minutes or shorter, from the viewpoint of suppressing an increase in the production cost.

In the reduction heating treatment in the reducing step S33, for example, first, nickel oxide and iron oxide are reduced and metalized to be an iron-nickel alloy (ferronickel), and form a shell (hereinafter, also referred to as a "shell"), in the vicinity of the surface of the mixture on which the reduction reaction is easily advanced, for a small amount of time of approximately 1 minute. On the other hand, in the shell, a slag component in the mixture gradually melted in accordance with the formation of the shell, and thus, a liquid phase slag is generated. Accordingly, in one mixture, an alloy such as ferronickel or a metal formed of metals (hereinafter, simply referred to as a "metal"), and a slag formed of an oxide (hereinafter, simply referred to as a "slag") are separately generated.

Then, in a case where approximately 10 minutes of the treatment time of the reduction heating treatment in the reducing step S33 elapses, a carbon component of the redundant carbonaceous reducing agent that is not involved in the reduction reaction is incorporated in the iron-nickel alloy, and thus, a melting point decreases. As a result thereof, the iron-nickel alloy containing carbon is dissolved into a liquid phase.

As described above, the slag that is formed by the reduction heating treatment is melted into a liquid phase, but is not mixed with the metal and the slag that are separately generated in advance, and is formed into the mixed product in which the slag is mixed as a phase separated from a metal solid phase and a slag solid phase by subsequent cooling. The volume of the mixed product contracts to a volume of approximately 50%~60%, compared to a mixture to be put.

The reduction treatment in the reducing step S33, as described above, is performed by using the reducing furnace or the like. For example, in a case where the reducing step S33 is performed in the treatment chamber 24 of the reducing furnace 2 in FIG. 4, it is preferable that the mixture is preheated in the treatment chamber 23 that is the preheating chamber, and then, is moved to the treatment chamber 24 in accordance with the rotation of the hearth.

(4) Temperature Retaining Step

The temperature retaining step S34 of performing retention in a predetermined temperature condition in the rotary hearth furnace may be performed with respect to the reduced product that is obtained through the reducing step S33. Specifically, the temperature retaining step S34 retains the reduced product at a temperature identical to the reduction temperature in the reducing step S33, and thus, further precipitates and gathers the metal component in the reduced product, and coarsens the metal. Accordingly, it is possible to easily recover the metal.

In a case where the metal component in the reduced product is small in a state obtained through the reduction treatment, for example, in a case where a bulky metal of approximately 200 μm or less is obtained, it is difficult to separate the metal and the slag from each other in the subsequent separating step S4. At this time, as necessary, the reduced product is retained at a high temperature, and thus, it is possible to precipitate and aggregate metals of which specific weight is greater than that of the slag in the reduced product, and to coarsen the metal.

A retaining temperature of the reduced product in the temperature retaining step S34 can be suitably set in accordance with the reduction temperature in the reducing step S33, and it is preferable that the retaining temperature is in a range of 1300° C. or more and 1500° C. or less. The reduced product is retained at a high temperature in such a temperature range, and thus, it is possible to efficiently precipitate the metal component in the reduced product, and to obtain a coarse metal. Here, in a case where the retaining temperature is lower than 1300° C., many parts of the reduced product are formed into a solid phase, and thus, the metal component is not precipitated, or even in a case where the metal component is precipitated, it takes time to obtain a coarse metal. In addition, in a case where the retaining temperature is higher than 1500° C., a reaction between the obtained reduced product and the hearth or the hearth carbonaceous reducing agent is advanced, and thus, there is a case where it is not possible to recover the reduced product, and the furnace is damaged.

A time for retaining the temperature in the temperature retaining step S34 is set in accordance with the temperature of the reducing furnace, and is preferably 10 minutes or longer, and is more preferably 15 minutes or longer. On the other hand, the upper limit of the time for retaining the temperature in the temperature retaining step S34 may be 50 minutes or shorter, or may be 40 minutes or shorter from the viewpoint of suppressing an increase in the production cost.

It is preferable that the treatment in the temperature retaining step S34 is continuously performed in the furnace in which the reduction reaction is performed, subsequent to the reducing step S33. For example, in a case where the temperature retaining step S34 is performed in the treatment chamber 25 of the reducing furnace 2 in FIG. 4, it is preferable that the mixture is subjected to the reduction treatment in the treatment chamber 24, and then, is moved to the treatment chamber 25 in accordance with the rotation of the hearth.

As described above, the metal component in the reduced product is efficiently precipitated by continuously performing the reducing step S33 and the temperature retaining step S34, and thus, it is possible to coarsen a metal to be obtained. In addition, a heat loss in each of the treatments is thus reduced, and thus, it is possible to perform an efficient operation.

Furthermore, in a case where the metal is coarsened to a level at which there is no problem in production by the reduction treatment in the reducing step S33, in particular, it is not necessary to provide the temperature retaining step S34.

(5) Cooling Step

The cooling step S35 is a step of cooling the reduced product through the reducing step S33, or as necessary, after the temperature is retained in the temperature retaining step S34 to a temperature at which the reduced product can be separated and recovered in the subsequent separating step S4.

The cooling of the reduced product in the cooling step S35 can be performed in at least one of a treatment chamber inside the furnace in which the reduction reaction is performed and a treatment chamber connected to the outside of the furnace. For example, in the reducing furnace 2 in FIG. 4, the treatment chamber 26 of the rotary hearth furnace 20 is used as the cooling chamber, and an external cooling chamber 27 is provided outside the furnace, and thus, a decrease in the temperature in the rotary hearth furnace 20 is reduced, and therefore, it is possible to reduce an energy loss in the reducing furnace 2. In addition, in particular, it is difficult to transmit heat to the external cooling chamber 27 from the rotary hearth furnace 20, and thus, it is possible to more smoothly perform the cooling of the reduced product.

In the cooling step S35, a temperature at which the reduced product through the reducing step S33 is moved to the cooling chamber (hereinafter, also referred to as a "recovery temperature") may be a temperature at which the reduced product is substantially treated as a solid. In particular, in a case where the reducing step S33 is performed by using the rotary hearth furnace, it is preferable that the recovery temperature is a temperature as high as possible. At this time, the recovery temperature increases as much as possible, and thus, a decrease in the temperature of the hearth of the rotary hearth furnace 20 until the reduced product is moved to the cooling chamber is reduced. For this reason, it is possible to reduce an energy loss due to cooling and preheating with respect to the rotary hearth or the atmosphere in the furnace, and to further save energy necessary for reheating.

Here, it is preferable that the recovery temperature in the cooling step S35 is 600° C. or higher. The recovery temperature is set to such a high temperature, and thus, the energy necessary for reheating is considerably reduced, and therefore, it is possible to perform an efficient smelting treatment at a lower cost. In addition, a temperature difference in the hearth of the rotary hearth furnace 20 decreases, and thus, a thermal stress that is applied to the hearth, a furnace wall, or the like also decreases, and therefore, it is possible to greatly extend the life of the rotary hearth furnace 20, and to considerably decrease problems during the operation of the rotary hearth furnace 20.

In this embodiment, in a case where the reaction in the reduction treatment step S3 is ideally advanced, the mixture after the reduction treatment step S3 is performed is the mixed product of the metal and the slag. At this time, a large lump of metal is formed, and thus, it is possible to reduce a labor for recovery at the time of performing the recovery from the reducing furnace, and to suppress a decrease in a metal recovery rate.

<4. Separating Step>

In the separating step S4, a metal (a ferronickel metal) is separated and recovered from the reduced product that is generated in the reduction treatment step S3. Specifically, a metal phase is separated and recovered from the mixed product (the reduced product) containing a metal phase (a metal solid phase) and a slag phase (a slag solid phase) that is obtained by performing the reduction heating treatment with respect to the mixture.

For example, a method of performing separation by using specific weight or a method of performing separation by using a magnetic force can be used as a method of separating the metal phase and the slag phase from the mixed product of the metal phase and the slag phase that is obtained as a solid, in addition to a method of removing unwanted substances by sieving. In addition, it is possible to easily separate the metal phase and the slag phase that are obtained due to poor wettability, and for example, it is possible to easily separate the metal phase and the slag phase from a large mixed product described above by dropping the mixed product with a predetermined drop, or by applying an impact such as applying a predetermined vibration at the time of performing sieving with respect to the mixed product.

As described above, the metal phase and the slag phase are separated from each other, and thus, it is possible to recover the metal phase, and to form a ferronickel product.

EXAMPLES

Hereinafter, the present invention will be described in more detail by examples, but the present invention is not limited to the following examples.

[Mixing Treatment Step]

In each sample of Examples 1 to 12 and Comparative Examples 1 to 4, a nickel oxide ore as a raw material ore, an iron ore, silica sand and lime stone as a flux component, a binder, and a carbonaceous reducing agent (a coal powder) were mixed by using a mixing machine while adding a proper amount of water.

Among them, the carbonaceous reducing agent was composed of particles (reducing agent particles) in which the value of a ratio of reducing agent particles having a maximum length of 25 μm or less to the total number of reducing agent particles, and the value of an average maximum particle length of reducing agent particles having a maximum length of greater than 25 μm were numerical values shown in Table 4. In addition, the content of the carbonaceous reducing agent was 31 mass % at the time of setting an amount necessary for sufficiently reducing nickel oxide and iron oxide ($Fe_2O_3$) contained in the nickel oxide ore as the raw material ore to 100 mass %.

Furthermore, the average maximum particle length shown in Table 4 was obtained from an average value of maximum particle lengths of reducing agent particles that was measured by randomly selecting 300 reducing agent particles from the reducing agent particles having the maximum length of greater than 25 μm by using a metal microscope.

Then, the raw material was mixed by using the mixing machine, and then, the raw material was kneaded by using a biaxial kneader, and thus, a mixture was obtained.

[Pretreatment Step]

The mixture that was obtained by a mixing treatment was molded into a spherical pellet of φ18±1.2 mm by using a pan-type granulator, and thus, was formed into a lump, and then, a drying treatment was performed by blowing hot air at 200° C. 250° C. such that a solid content was approximately 70 weight %, and moisture was approximately 30 weight %. In Table 3 described below, a solid content composition (excluding carbon) of the mixture (pellet) after the drying treatment is shown.

TABLE 3

| Composition of solid content in pellet after drying [mass %] | | | | | | |
|---|---|---|---|---|---|---|
| Ni | $Fe_2O_3$ | $SiO_2$ | CaO | $Al_2O_3$ | MgO | Others |
| 1.6 | 53.3 | 14.0 | 5.4 | 3.2 | 5.7 | Binder, carbonaceous reducing agent |

[Reduction Treatment Step]

The pellet after being subjected to a pretreatment was put into each reducing furnace including a rotary hearth furnace in which the atmosphere was set to a nitrogen atmosphere substantially not containing oxygen. As illustrated in FIG. 4, the reducing furnace was provided with the rotary hearth furnace 20 including four treatment chambers 23 to 26 such that a region in which the hearth was subjected to rotary movement was divided into four regions. In the reducing furnace 2, the drying chamber 21 is connected to the treatment chamber 23 of the rotary hearth furnace 20, and the external cooling chamber 27 is connected to the treatment chamber 26 of the rotary hearth furnace 20.

Then, the pellet was put into the drying chamber 21 connected to the outside of the furnace of the rotary hearth furnace 20 and was subjected to the drying treatment, and then, was moved to treatment chamber 23 that is a preheating chamber provided in the rotary hearth furnace 20 continuously to the drying chamber 21, and a preheating treatment was performed with respect to the pellet by retaining the temperature in the preheating chamber to be in a range of 700° C. or more and 1280° C. or less.

Subsequently, the pellet after the preheating treatment was moved to the treatment chamber 24 in the rotary hearth furnace 20, and was subjected to a reduction treatment at a temperature shown in Table 4 and for a time shown in Table 4.

A reduced product of the pellet that was obtained through the reduction treatment was sequentially moved to the treatment chamber 25 that is a temperature retaining chamber maintained at a temperature identical to a reduction temperature shown in Table 4, and the treatment chamber 26 that is a cooling chamber, and then, was moved to the external cooling chamber 27 connected to the rotary hearth furnace 20, was rapidly cooled to a room temperature while flowing nitrogen, and was taken out to the atmosphere. Furthermore, the recovery of the reduced product from the rotary hearth furnace 20 was performed at the time of moving the reduced product to the external cooling chamber 27, and the reduced product was recovered by allowing the reduced product to let along a guide provided in the external cooling chamber 27.

In addition, in each of the samples after a reduction heating treatment, a nickel metallization rate and a nickel content ratio in a metal were analyzed by an ICP emission spectrophotometer (SHIMAZU S-8100 type), and were calculated.

The nickel metallization rate and the nickel content ratio in the metal were calculated by the following expressions.

Nickel Metallization Rate=Metalized Amount of Ni in Pellet÷(Total Amount of Ni in Pellet)×100 (%)

Nickel Content Ratio in Metal=Metalized Amount of Ni in Pellet÷(Total Metalized Amount of Ni and Fe in Pellet)×100(%)

In Table 4 described below, the nickel metallization rate of the metal obtained from each of the samples of Examples 1 to 12 and Comparative Examples 1 to 4 and the nickel content ratio in the metal are shown.

TABLE 4

| Sample No. | Ratio of reducing agent particles having maximum length of less than or equal to 25 μm [%] | Average maximum particle length of reducing agent particles having maximum particle length of greater than 25 μm [μm] | Reducing temperature [° C.] | Reduction time [minute] | Ni metallization rate [%] | Ni content in metal [%] |
|---|---|---|---|---|---|---|
| Example 1 | 2.1 | 50.7 | 1300 | 35 | 98.6 | 18.2 |
| Example 2 | 12.3 | 50.2 | 1300 | 35 | 99.5 | 19.2 |
| Example 3 | 24.8 | 50.5 | 1300 | 35 | 98.5 | 18.5 |
| Example 4 | 2.3 | 50.1 | 1400 | 15 | 99.1 | 18.8 |
| Example 5 | 12.7 | 50.3 | 1400 | 15 | 99.6 | 19.3 |
| Example 6 | 24.5 | 50.8 | 1400 | 15 | 98.7 | 18.8 |
| Example 7 | 12.5 | 30.3 | 1300 | 35 | 99.1 | 19.2 |
| Example 8 | 12.9 | 50.6 | 1300 | 35 | 99.1 | 19.6 |
| Example 9 | 12.2 | 79.3 | 1300 | 35 | 98.3 | 18.6 |
| Example 10 | 12.3 | 30.2 | 1400 | 15 | 99.2 | 19.5 |
| Example 11 | 12.6 | 50.6 | 1400 | 15 | 99.8 | 19.8 |
| Example 12 | 12.8 | 78.8 | 1400 | 15 | 98.4 | 18.3 |
| Comparative Example 1 | 0.5 | 50.1 | 1300 | 35 | 90.6 | 15.3 |
| Comparative Example 2 | 35.6 | 50.4 | 1300 | 35 | 82.3 | 14.5 |
| Comparative Example 3 | 12.4 | 27.3 | 1300 | 35 | 80.8 | 14.8 |
| Comparative Example 4 | 12.1 | 125.8 | 1300 | 35 | 78.6 | 11.3 |

As shown in the result of Table 4, it was known that the carbonaceous reducing agent was composed of the particles (the reducing agent particles) in which the number of reducing agent particles having the maximum particle length of 25 μm or less with respect to the total number of reducing agent particles of the carbonaceous reducing agent was 2% or more and 25% or less, and the average maximum particle length of the reducing agent particles having the maximum particle length of greater than 25 μm was 30 μm or more and 80 μm or less, and thus, the nickel metallization rate was as high as 98.3% or greater, a nickel content in the metal was also as high as 18.2% or greater, and it was possible to produce high quality ferronickel (Example 1 to Example 12). In particular, in Examples 1 to 8, 10, and 11 in which the average maximum particle length of the reducing agent particles having the maximum particle length of greater than 25 μm was 60 μm or less, it was known that the nickel metallization rate was as high as 98.5% or greater, and it was possible to produce higher quality ferronickel.

As described above, it is considered that the reason that high quality ferronickel can be produced is because the aggregation or the uneven distribution in the mixture is suppressed by containing a fine carbonaceous reducing agent, and thus, the contact area between the nickel oxide ore and the carbonaceous reducing agent, or the homogeneity of the mixture increases, and thus, it is possible to homogeneously and efficiently perform the ore refining treatment.

In contrast, as shown in the result of Comparative Example 1 and Comparative Example 2, in a case where the number of reducing agent particles having the maximum particle length of 25 μm or less was less than 2% (Comparative Example 1) or greater than 25% (Comparative Example 2), the nickel metallization rate was 90.6% at the highest, and the nickel content in the metal was 15.3% at the highest, which were values lower than those of the Examples.

In addition, as shown in the result of Comparative Example 3 and Comparative Example 4, in a case where the average maximum particle length of the reducing agent particles having the maximum particle length of greater than 25 μm was less than 30 μm (Comparative Example 3) or greater than 80 μm (Comparative Example 4), the nickel metallization rate was 80.8% at the highest, and the nickel content in the metal was 14.8% at the highest, which were values lower than those of the Examples.

EXPLANATION OF REFERENCE NUMERALS

1 REDUCING AGENT PARTICLES
10 MIXTURE
2 REDUCING FURNACE
20 ROTARY HEARTH FURNACE
21 DRYING CHAMBER
23 to 26 TREATMENT CHAMBER
27 EXTERNAL COOLING CHAMBER

The invention claimed is:

1. A method for smelting a nickel oxide ore of obtaining a ferronickel that is a reduced product and a slag by mixing a nickel oxide ore and a carbonaceous reducing agent, and by performing heating for a reduction treatment with respect to a mixture that is obtained, wherein the carbonaceous reducing agent is composed of particles (reducing agent particles), a ratio of a number of reducing agent particles which are contained in the carbonaceous reducing agent and have a maximum particle length of 25 μm or less is 2% or more and 25% or less of a total number of reducing agent particles contained in the carbonaceous reducing agent, and an average maximum particle length of reducing agent particles having a maximum particle length of greater than 25 μm that is obtained by Expression (1) described below is 30 μm or more and 80 μm or less, Average Maximum Particle Length=Sum of Maximum Particle Length of 300 Reducing Agent Particles/300 Expression (1).

2. The method for smelting a nickel oxide ore according to claim 1, wherein a reduction temperature in the reduction treatment is 1200° C. or more and 1450° C. or less.

* * * * *